US008591269B2

(12) United States Patent
Fürholzer

(10) Patent No.: US 8,591,269 B2
(45) Date of Patent: Nov. 26, 2013

(54) SHIELDING TERMINAL CLAMP

(75) Inventor: Roland Fürholzer, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/537,944

(22) Filed: Jun. 29, 2012

(65) Prior Publication Data

US 2013/0005198 A1 Jan. 3, 2013

(30) Foreign Application Priority Data

Jun. 30, 2011 (EP) ..... 11172167

(51) Int. Cl.
*H01R 4/48* (2006.01)

(52) U.S. Cl.
USPC ..... 439/819; 439/817

(58) Field of Classification Search
USPC ..... 439/816, 817, 819, 820
See application file for complete search history.

(56) References Cited

U.S. PATENT DOCUMENTS

| | | | | |
|---|---|---|---|---|
| 4,929,198 | A | 5/1990 | Strate et al. | |
| 6,328,580 | B2 * | 12/2001 | Hanning et al. | 439/98 |
| 7,354,319 | B2 | 4/2008 | Camino et al. | |
| 2013/0005184 | A1 * | 1/2013 | Drehmann | 439/607.01 |

FOREIGN PATENT DOCUMENTS

| | | |
|---|---|---|
| DE | 10 2006 020 125 | 11/2007 |
| EP | 0 33 4975 | 10/1989 |
| EP | 1 798 819 | 6/2007 |
| WO | WO 2007053871 | 5/2007 |

* cited by examiner

*Primary Examiner* — Tho D Ta
(74) *Attorney, Agent, or Firm* — Cozen O'Connor

(57) ABSTRACT

A shielding terminal clamp having a first limb, a second limb and a yoke having a base part, with an elastic element disposed between the first limb and second such that a pressure force is exerted on a pressure piece movably supported between first and second guide pieces of the first and second limbs, respectively, first and second ends of the elastic element being respectively disposed on the base part and the pressure piece such that the pressure force acts in the direction of an open end of the yoke opposite the base part, with a closing device, which is displaceable disposed on the yoke such that a movement in a direction extending orthogonally to the pressure force, with which the closing device and the yoke move toward one another, causes a shielding bus clamping of between the open end of the yoke and the closing device.

7 Claims, 1 Drawing Sheet

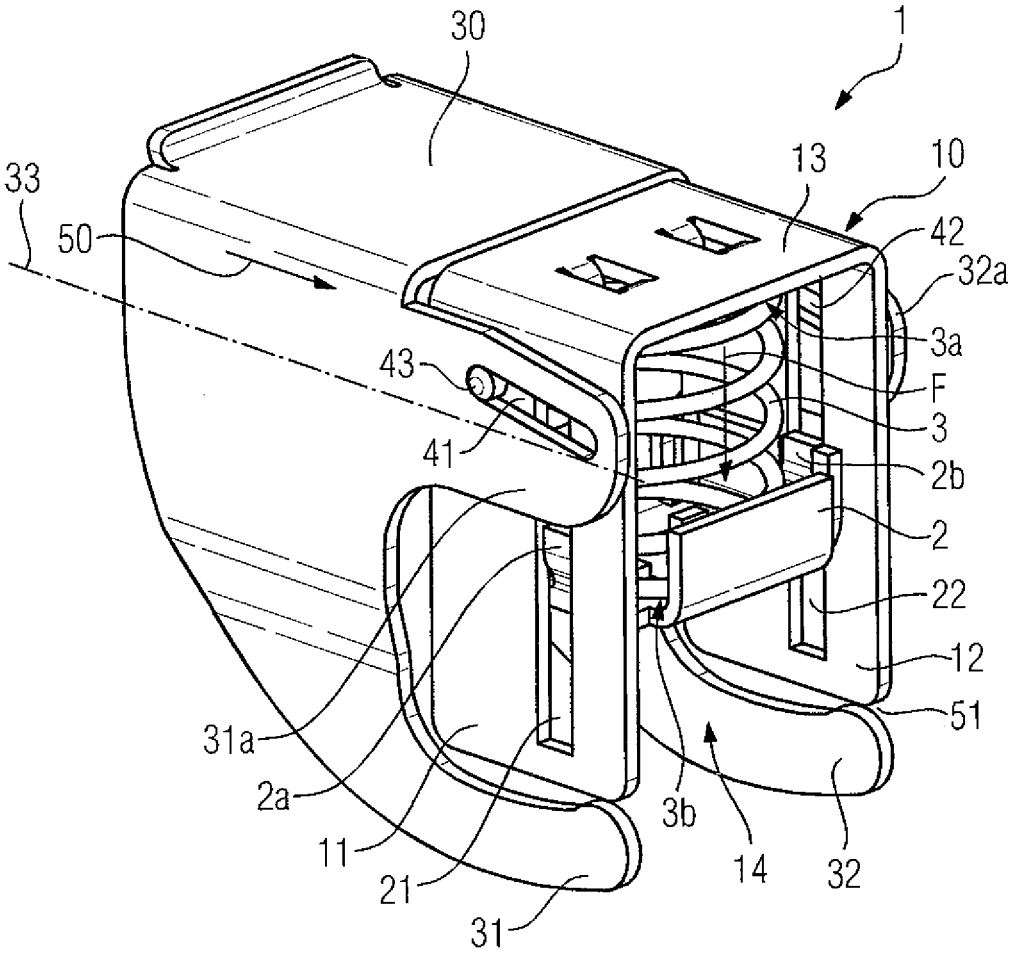
30
1
13
10
33
50
42
32a
3a
43
F
3
41
2b
2
22
12
51
31a
2a
3b
11
14
32
21
31

SHIELDING TERMINAL CLAMP

BACKGROUND OF THE INVENTION

1. Field of the Invention

The invention relates to cable clamps and more particularly, to a shielding terminal clamp including a first limb, a second limb and a U-shaped yoke having a base part, where an elastic element is disposed between the first limb and the second limb such that a pressure force is exerted on a pressure piece.

It should be understood that within the meaning and scope of the invention, a shielding terminal clamp refers to a clamping apparatus, which can be used to clamp a cable shield of a cable with signal lines to a shielding bus, thereby allowing contact transition with the lowest possible impedance and resistance from the shielding braid by the shielding terminal clamp to a shielding bus.

2. Description of the Related Art

European patent EP 0 334 975 B1 disclose a conventional shielding terminal clamp. However this conventional shielding terminal clamp has the disadvantage that complex assembly outlay is required to connect the shielding clamp and the shielding bus.

SUMMARY OF THE INVENTION

It is therefore an object of the invention to provide a shielding terminal clamp, with which the assembly of a cable with a shielding braid on a shielding bus is facilitated.

This and other objects and advantages are achieved in accordance with the invention by providing a shielding terminal clamp in which a first limb includes a first guide device disposed along the first limb and a second limb includes a second guide device disposed along the second limb, where a pressure piece is supported in a movable manner between the first and second guide devices, a first end of the elastic element is disposed on a base part and a second end of the elastic element is disposed on the pressure piece such that the pressure force acts in the direction of an open end of the yoke opposite the base part. The a shielding terminal clamp also includes a closing device disposed on the U-shaped yoke in a displaceable manner such that a movement in a movement direction running orthogonally to the pressure force, with which the closing means and U-shaped yoke move toward one another, causes a shielding bus to be clamped between the open end of the yoke and the closing means. With the shielding terminal clamp in accordance with the invention, it is advantageous that a pressure piece supported in a sliding manner is present in the U-shaped yoke, which is pushed downward with a constant force by an elastic element with a spring, for example, the U-shaped configuration of the yoke allows one or more cables to be inserted into the space formed by the U, where the shielding braid is already open in the case of the cables. The elastic element now ensures that the cable, with its shielding braid, is pushed in the direction of the open end by the pressure piece, so that when the cable is clamped to a shielding bus, this is disposed at the open end. In contrast to the conventional shielding terminal clamps, the shielding terminal clamps of the present invention is simpler, due to the closing means being supported in a sliding manner, to fasten a cable with its cable shield to a shielding bus. Here, the closing device is configured such that the shielding bus is clamped between the open end of the yoke and the closing device. Such clamping can even be achieved by a one-handed operation.

In a particular embodiment of the shielding terminal clamp, the closing device is also configured is a U-shape and has a curved first and second claw.

It has proven advantageous for the closing device to have a first and second web, with a first and second slot being disposed respectively in the webs and the U-shaped yoke having a guide bolt, where the guide bolt is disposed in the slots. The closing device is thus supported on the U-shaped yoke such that the closing device can be rotated and displaced on the guide bolt. This also allows a pivotal movement of the closing device and also allows a translational sliding movement in the direction of the U-shaped yoke. Such a shielding terminal clamp structure is therefore configured in a user-friendly manner because, on the one hand, a number of shielded lines in particular can be pushed onto a shielding bus with almost constant force, without additional tools or materials having to be used in the process and, on the other hand, assembly can occur with one hand.

In a further optimized embodiment of the shielding terminal clamp, the first and second slots are disposed such that they extend at an angle to a web line and thus, when the closing device and U-shaped yoke move toward one another, allow a distance between the claws and the open end of the yoke to get larger. This has the technical effect that during the movement toward one another the distance between the claws and the shielding bus increases with every millimeter traveled by the guide bolt in the slots, thereby creating space for the shielding bus.

It is also advantageous, if the elastic element comprises a spring. It has proven useful in practice in particular to use a spiral spring.

It is also advantageous for the pressure piece to be configured as a sheet metal part with embossed lugs and for the lugs to be guided in the guide device that comprise slits.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The drawing with its FIGURE shows an exemplary embodiment of a possible configuration of the shielding terminal clamp in accordance with the invention.

DETAILED DESCRIPTION OF THE PREFERRED EMBODIMENTS

With specific reference to the FIGURE, shown therein is a shielding terminal clamp 1 including a U-shaped yoke 10 with a first limb 11, a second limb 12 and a base part 13. An elastic element 3, i.e., a spiral spring, is disposed between the first limb 11 and the second limb 12 such that a pressure force F is exerted on a pressure piece 2. The first limb 11 has a first guide 21 disposed along the first limb 11 and the second limb 12 has a second guide 22 disposed along the second limb 12, where the first and second guide 21, 22 are disposed in the manner of slits in the limbs 11, 12. The pressure piece 2 with a first lug **2*a* and a second lug 2*b* can be disposed in a sliding manner in these slits and is therefore prevented from slipping. A first end 3*a* of the elastic element 3 is disposed on an inner face of the base part 13 and a second end 3***b* of the elastic element 3 is disposed on an inner face of the pressure piece 2, this arrangement allowing the pressure force F to act in the direction of an open end 14 of the yoke 10 opposite the base part 13.

A closing device 30, comprising a type of lever, is disposed on the U-shaped yoke 10 in a displaceable manner such that a movement in a direction 50 extending orthogonally to the pressure force F, with which the closing device 30 and U-shaped yoke 10 move toward one another, causes a shielding bus to be clamped between the open end 14 of the U-shaped yoke 10 and the closing device 30. To this end, the closing device 30 preferably has a first claw 31 and a second claw 32. Because the closing device 30 comprises a pivotable hook or lever, the first and second claws 31, 32 can be pivoted under the shielding bus.

For an overlaid movement consisting of a rotational movement and a pushing movement to pivot the first and second claws 31, 32 under the bus bar, the closing device 30 has a first web 31*a* and a second web 32*a* that encompass the U-shaped yoke 10. Disposed in the first and second webs 31*a*, 32*a* are a first slot 41 and a second slot 42, respectively. Here, the first and second slots 41, 42 extend at an angle to a web line 33. The web line 33 should be viewed as a putative reference line, to measure an angle formed by the web line 33 and a line of symmetry passing along the slot.

The oblique arrangement of the slots 41, 42 in relation to the web line 33, when the closing device 30 and U-shaped yoke 10 move toward one another, allows a distance 51 between the claws and the open end 14 of the yoke 10 to get larger, which in turn means that space is created for the shielding bus such that an upper face of the shielding bus rests against the ends of the limbs and a lower face of the shielding bus lies in a bend of the claws 31, 32. The claws 31, 32 here are configured such that the ends of the first and second claws 31, 32 do not taper to a point but have a bulge in the manner of a drop shape. The increased distance and the subsequent pivoting of the first and second claws 31, 32 allow the bulges to engage with the longitudinal face of the shielding bus, thereby securing the shielding clamp to stop it from slipping.

The disclosed embodiments of the invention makes the assembly of a shielding terminal clamp much simpler compared with conventional shielding terminal clamps. During assembly of the shielding terminal clamp, it is possible to first place the U-shaped yoke 10 over the cables or lines to be shielded and to push the U shaped yoke 10 onto the shielding bus counter to the spring force of the spiral spring up to the stop. In this assembly step, the closing device 30 is in a rear, pivoted out position. This ensures that the open end 14 of the U-shaped yoke 10 is not covered by the closing device 30.

Here, assembly with one hand is accommodated in particular by the fact that the pressure piece is now pushed upward along the laterally disposed slits in the limbs counter to the spring force and the closing device 30 is then moved by an overlaid pushing and pivoting movement such that the two claws 31, 32 engage under the shielding bus.

In an assembled (i.e., locked) state, the spring force causes the pressure piece to push against the shielding braid of the cables laid in the U-shaped yoke 10. With such an embodiment, it is advantageous now that only one thin cable, for example, can be clamped or a plurality of cables can be clamped in the permitted cable stowage space generally available within the U-shaped yoke 10.

The described structure with the shielding terminal clamp in accordance with the disclosed embodiments has the following advantages:

The manner of assembly is obvious to a user and can be executed intuitively without further description. During assembly there is no friction force to be overcome between the pressure piece and the cables, because the closing device 10 (lever with claws) can be moved in an almost frictionless manner independently of the other elements. An uncontrolled automatic opening of the shielding terminal clamp is prevented by the angled position of the first and second slots 41, 42 in the first and second webs 31*a*, 32*a*, as an additional force must be exerted for opening purposes. The distance between the upper surface of the U-shaped yoke 10 and the shielding bus, i.e., the surface formed by the base part 13, is always the same size and invariable, no matter how many cables are present in the cable stowage space. This is advantageous for a regular and well-ordered structure within a switch cabinet. The number of clampable cables (and therefore the cross section of the cables) is large compared with the size of the shielding clamp. In many instances, it is therefore not necessary to divide the cables between a number of shielding terminal clamps. With this type of shielding terminal clamp 1, the cables are shielded all round. There is no opening at any point and therefore no break in the shield. No additional tools are necessary to produce a shielding connection with the shielding terminal clamp 1. The shielding terminal clamp 1 is therefore not a single-use product but is reusable.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A shielding terminal clamp comprising:

a U-shaped yoke having a base part, a first limb having a first guide disposed along the first limb, and a second limb having a second guide disposed along the second limb;

a pressure piece movably supported between the first and second limbs;

an elastic element disposed between the first limb and the second limb such that a pressure force is exerted on the pressure piece, a first end of the elastic element being disposed on the base part and a second end of the elastic element being disposed on the pressure piece such that the pressure force acts in a direction of an open end of the U-shaped yoke opposite the base part; and a closing device disposed on the U-shaped yoke in a displaceable manner such that a movement in a direction extending orthogonally to the pressure force, with which the closing device and the U-shaped yoke move toward one another, causes clamping of a shielding bus between the open end of the yoke and the closing device.

2. The shielding terminal clamp as claimed in claim 1, wherein the closing device is configured in a U-shape and includes a curved first claw and a curved second claw extending from sides of the U-shape.

3. The shielding terminal clamp as claimed in claim 1, wherein the closing device includes a first web and a second web, a first slot and a second slot being disposed respectively in the first and second webs, the U-shaped yoke having a guide bolt disposed in the slots.

4. The shielding terminal clamp as claimed in claim 2, wherein the closing device includes a first web and a second web, a first slot and a second slot being disposed respectively in the first and second webs, the U-shaped yoke having a guide bolt disposed in the slots.

5. The shielding terminal clamp as claimed in claim 3, wherein the first and second slots are disposed to extend at an angle to a web line such that, when the closing means and U-shaped yoke move toward one another, a distance between the first and second claws and the open end of the U-shaped yoke is allowed to get larger.

6. The shielding terminal clamp as claimed in claim 1, wherein the elastic element comprises a spring.

7. The shielding terminal clamp as claimed in claim 1, wherein the pressure piece comprises a sheet metal part with embossed lugs and the lugs are guided in the guides comprising slits.

* * * * *